US005732796A

United States Patent [19]

Ahigian et al.

[11] Patent Number: 5,732,796

[45] Date of Patent: Mar. 31, 1998

[54] ELEVATOR CAR EVACUATION DETERRENT DEVICE

[75] Inventors: Edward E. Ahigian, Chicago, Ill.; David W. Barrett, East Hartland, Conn.; Thomas M. McHugh, Farmington, Conn.; Jerome F. Jaminet, South Windsor, Conn.; Thomas He, Unionville, Conn.; Richard E. Peruggi, Glastonbury, Conn.; Thomas M. Kowalczyk, Farmington, Conn.; Richard E. Kulak, Bristol, Conn.

[73] Assignee: Otis Elevator Company, Farmington, Conn.

[21] Appl. No.: 550,970

[22] Filed: Oct. 31, 1995

[51] Int. Cl.[6] ..... B66B 13/14

[52] U.S. Cl. ..... 187/314; 187/330

[58] Field of Search ..... 198/330, 314, 198/335, 334

[56] References Cited

U.S. PATENT DOCUMENTS

| | | | |
|---|---|---|---|
| 1,950,150 | 3/1934 | Norton et al. | 187/314 |
| 3,783,977 | 1/1974 | Voser | 187/52 |
| 4,357,998 | 11/1982 | Gibson et al. | 187/334 |
| 5,005,673 | 4/1991 | Rivera | 187/52 |
| 5,651,427 | 7/1997 | Kulak et al. | 187/330 |
| 5,651,428 | 7/1997 | Ahigian | 187/330 |

FOREIGN PATENT DOCUMENTS

| | | | |
|---|---|---|---|
| 824928 | 2/1938 | France . | |
| 354129636A | 10/1979 | Japan | 187/314 |

OTHER PUBLICATIONS

U.S. Patent Application Serial No. 08/225,220 filed Apr. 8, 1994 entitled Stationary Actuator Moving Vane Elevator Car Door Coupling.

U.S. Patent Application Serial No. 08/550,971 filed Oct. 31, 1995 entitled Elevator Door Coupling and Hold–Close Apparatus.

*Primary Examiner*—William E. Terrell
*Assistant Examiner*—Khoi H. Tran

[57] ABSTRACT

An elevator door evacuation deterrent device in combination with a moving vane elevator door coupler having a pair of coupler vanes pivotally connected by links to form a parallelogram movable between a compressed position, an expanded interlock position and a third expanded overtravel locking position when the elevator car is outside a landing zone. A top end from one of the vanes projects upwardly and abuts a locking plate on the elevator car to limit movement of the car door in the overtravel locking position when the car is outside of a landing zone.

6 Claims, 3 Drawing Sheets

ELEVATOR CAR EVACUATION DETERRENT DEVICE

TECHNICAL FIELD

This invention relates to elevator door operation and more particularly to an evacuation deterrent device which prevents passengers from opening the elevator car doors when the car is outside of the landing zone.

BACKGROUND OF THE INVENTION

Present day elevator door systems have doors mounted on the elevator car and doors mounted at each hall landing of the elevator hoistway. The hoistway doors at the hall landings are mounted directly to the building structure and are kept closed whenever the car is not present at the related landing in order to prevent passengers and objects from entering the hoistway. The elevator car carries an electric motor and door operator for operating the car doors. Instead of having door operators for each of the hoistway doors, the hoistway doors are typically opened by coupling them with the car doors so that opening of the car doors will open the hoistway doors in unison therewith, thereby protecting passengers in the car from the building structure and protecting passengers at the landing from the hoistway. Thus, there will be a connection, i.e., a coupling connection, between the car and hoistway doors when the doors are opening or closing and there will be no such connection when the car is moving through the hoistway.

Present elevator codes (ANSI-A17-1) require an evacuation deterrent device to prevent passengers from opening the car doors and exiting the elevator car outside of the door landing zones. A maximum landing zone size is eighteen inches so that, for example, the deterrent device must be operative to hold the car doors closed whenever the car is more than eighteen inches from the landing and inoperative whenever the car is within the landing zone. Some prior deterrent devices are overly complex in structure and operation. Other devices utilize auxiliary cams, rollers, solenoids or angles at each landing in the hoistway which are costly and/or present reliability problems. Further, prior devices were often inconvenient to bypass during rescue situations.

In addition to providing a new and improved evacuation deterrent device, it will be desirable to provide such a device that could be integrated with a door coupler assembly.

DISCLOSURE OF THE INVENTION

It is an object of the present invention to provide a new and improved evacuation deterrent device.

A further object of the present invention is to provide an evacuation deterrent device which can be integrated with a moving vane door coupler.

Another object of the invention is to provide such a device which can be advantageously utilized with other interlocking devices having accessible interlock rollers.

Another object is to provide such a device which is disposed on the elevator car so as to minimize complexity, alignment and adjustment.

A still further object of the invention is to provide such a device which minimizes components.

A still further object of the invention is to provide such a device which affords convenient bypass so as to allow field/service personnel to bypass the device and open the car doors without moving the car doors.

Another object of the invention is to provide such a device which is cost-efficient to manufacture, robust, relatively uncomplicated and reliable in operation.

Other objects will be in part obvious and in part pointed out more in detail hereinafter.

It has been found that the foregoing and related objects are attained and the disadvantages in the art are overcome in an evacuation deterrent device having a vane assembly mounted to the car door for movement therewith with first and second vanes pivotally connected by first and second links to form a parallelogram. The parallelogram is pivotally movable between a first compressed position, a second intermediate expanded position where the vanes are positioned to engage a pair of bumpers on an adjacent hallway door and a third overtravel locking position. A lock plate is fixed to the elevator car and the first vane has a first end configured to abut the locking plate when the vane assembly is in third overtravel position to limit the movement of the car door and to clear the locking plate when the vane assembly is in the second intermediate position to allow full movement if the car door.

BEST MODE FOR CARRYING OUT THE INVENTION

Figure 1:
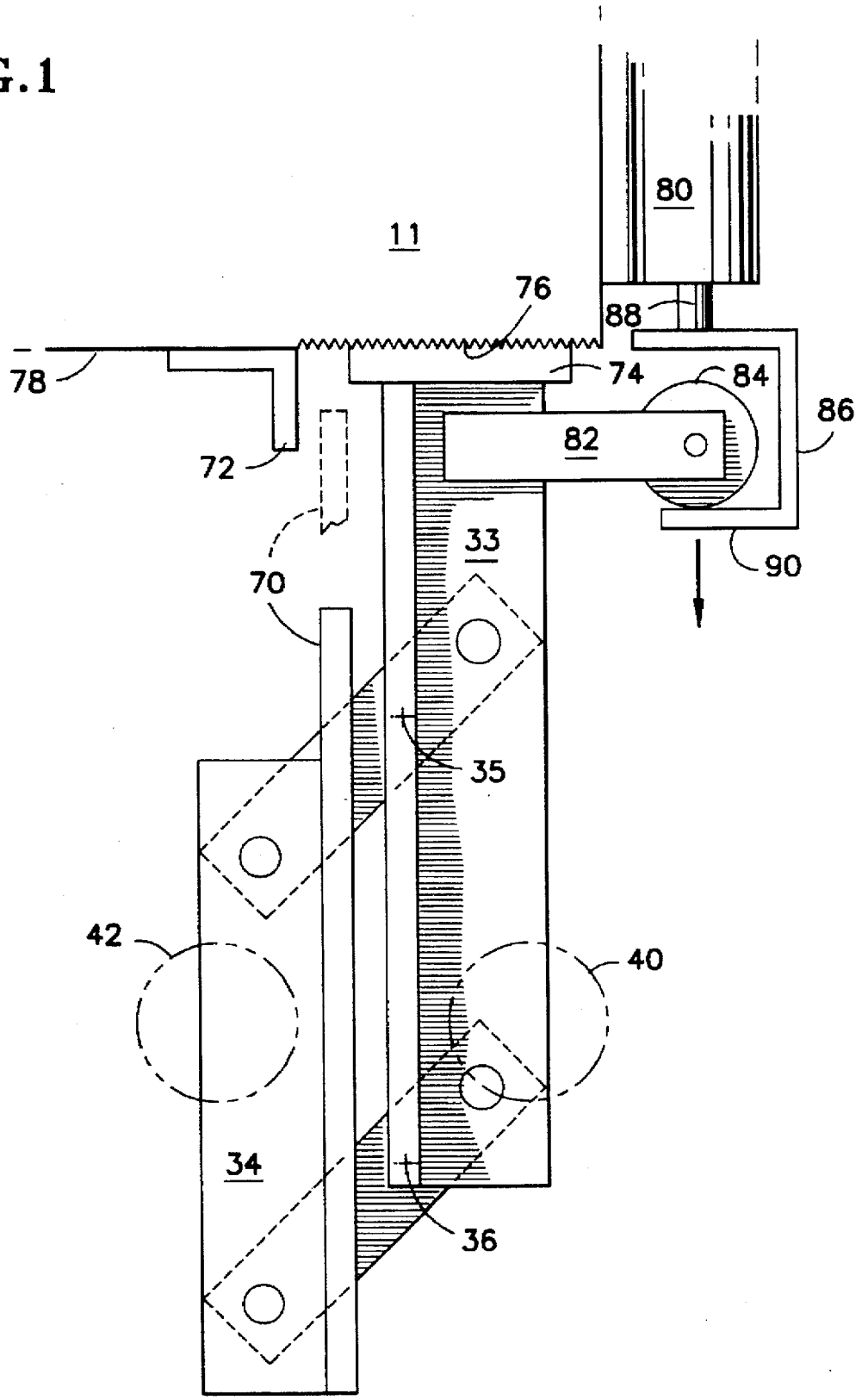
FIG. 1 is a simplified diagram of a door coupler and the present invention.

Although specific forms of the present invention have been selected for illustration in the drawings, and the following description is drawn in specific terms for the purpose of describing these forms of the invention, the description is not intended to limit the scope of the invention which is defined in the appended claims.

Figure 2:
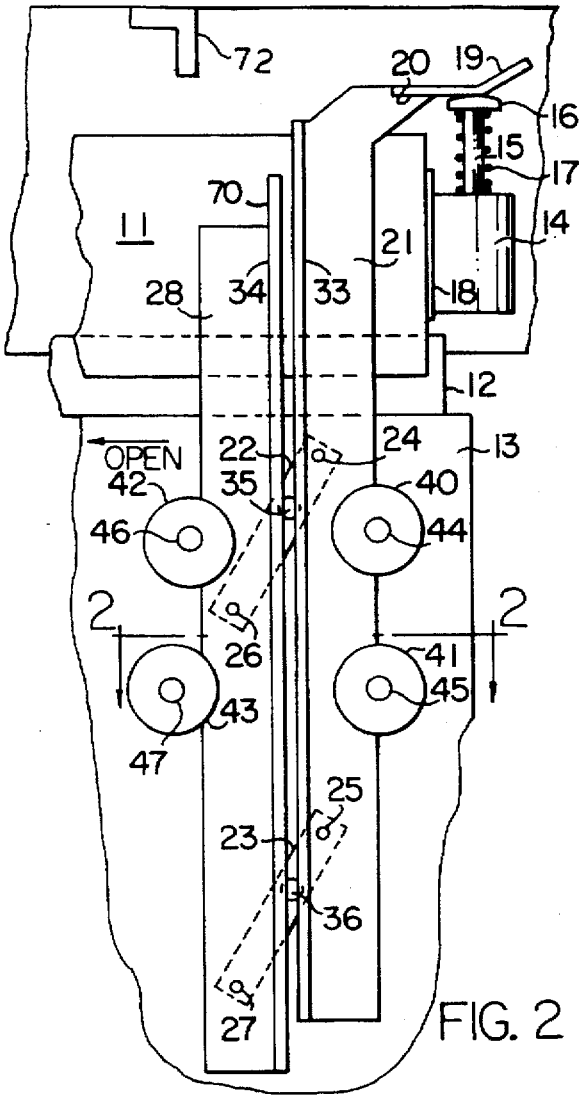
FIG. 2 is a partial, front elevation view taken on the line 1—1 of FIG. 3 of a door coupler (in the uncoupled position) of the type illustrated in FIG. 1.
Figure 3:
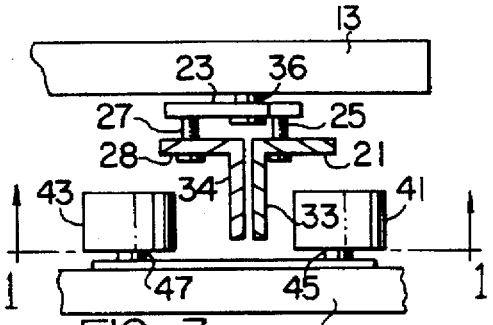
FIG. 3 is a partial, partially sectioned top plan view taken on the line 2—2 of FIG. 2, showing the coupler in the uncoupled position.
Figure 4:
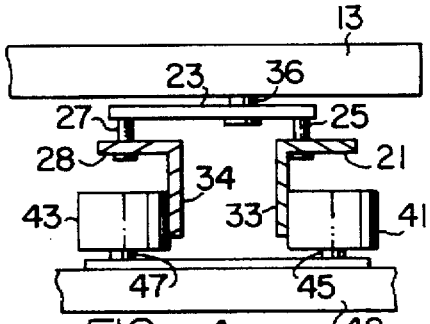
FIG. 4 is a top plan view, partially sectioned, similar to FIG. 3 but showing the coupler in the coupled position.

Referring first to FIG. 2 for a description of the type of moving vane coupler suited for combination with the present invention, an elevator car 10 has a linear induction motor 11 disposed thereon so as to operate a secondary motor 12 thereof which is secured in some fashion to an elevator car door 13 so as to cause the door to open and close in response to suitable demand. The door 13 is shown in its fully closed position and actuation of the linear induction motor 11, 12 will cause the door to move toward the left as seen in FIG. 2, into the open position. Attached to the primary 11 of the motor is a solenoid actuator 14, the armature 15 of which is connected to a cap 16 which is normally forced upward (in FIG. 2) by a spring 17. With the car 16 in the position shown in FIG. 2, it is in contact with a shelf 20 on an angle 21 which is disposed to a pair of links 22, 23 by corresponding pivots 24, 25. The other end of each link 22, 23 is connected by pivots 26, 27 to another angle 28. The angles 21 and 28 (as seen in FIGS. 3 and 4) in this embodiment may be angles with about equal legs. The solenoid actuator 14 is mounted on a bracket 18 that brings it forward of the front edge of the motor primary 11; the shelf 20 similarly extends forward of the angle 21. The shelf 20 is bent to form a ramp 19. The legs, shown edgewise in FIG. 2, comprise substantially vertically disposed parallel vanes 33, 34. Each link 22, 23 is disposed by a corresponding pivot 35, 36 to the elevator car door 13.

Figure 5:
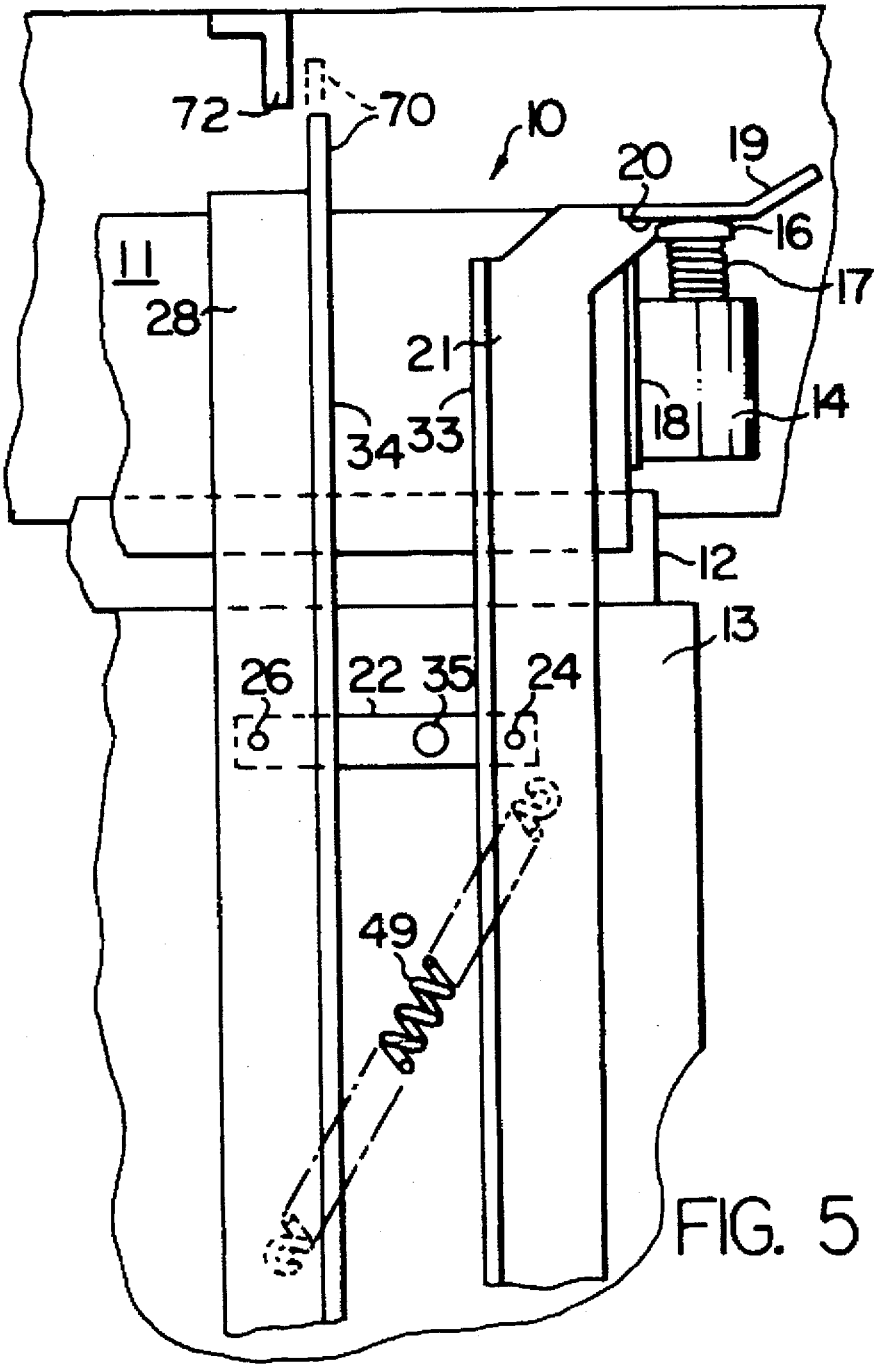
FIG. 5 is a partial, front elevation view of the apparatus of FIG. 2 in the coupled position.

Downward actuation of the solenoid actuator 14 as seen in FIG. 5, will allow the links 22, 23 to rotate about the pivots 35, 36 causing the vane 33 to be lowered and the vane 34 to be raised into the positions shown in FIG. 5. This will cause the vanes 33, 34 to be wedged (FIG. 4) between a plurality of rollers, such as rollers 40–43, which are mounted by corresponding axles 44–47 on an elevator hoistway door 48. The movement of the solenoid actuator 14 may, if desired, be chosen to lower the vane 33 and raise the vane 34 sufficiently so that the links 22, 23 will be rotated just past the position at which the two vanes 33, 34 are at the maximal distance from each other as shown in FIG. 5. This can be achieved by a tension spring 49, shown for convenience only in FIG. 5, which is attached to the car door side of the angles 21, 22 (the back in FIG. 5). With the links 22, 23 in the position shown in FIG. 5, there is no chance that the two vanes will resume the uncoupled position shown in FIGS. 2 and 3 as consequence of vibration and other mechanical shock resulting from the opening of the car door. The force required to open or close the doors is transmitted horizontally through the links 22, 23 and therefore does not tend to close the parallelogram.

When the car door 13 opens by traveling to the left as seen in FIGS. 2–5, the shelf 20 will simply slide away from the cap 16. Car door motion has no effect on the positioning of the blades 33, 34. The solenoid 14 may remain in an energized condition with the shelf 20 in a fully lowered position (as in FIG. 5), so that the shelf 20 can slide back above it when the elevator door 13 is closed. Then, the solenoid 14 can be disenergized so the spring 17 will raise the shelf 20 and pull the angle 21 upwardly to the position shown in FIG. 2, thereby restoring the vanes 33, 34 into the uncoupled position shown in FIGS. 2 and 3. This provides clearance so that the elevator may travel upwardly and downwardly in the hoistway without contacting any of the rollers 40–43 (or similar rollers on other hoistway doors in the same elevator hoistway). The actuator 14 may be rotary or of some other configuration, so long as it can open the vanes without door motion. The nature of all of the details of the actuator 14, the ramp 19 and the surface 20 is a function of the particular installation in which the invention may be practiced.

In the disclosed embodiment, the rollers comprise four rollers 40–43 arranged in pairs, each roller of a pair 40, 42, when coupled, being disposed essentially vertically above the other roller of the pair 40, 43, respectively. This provides the greatest degree of horizontal stiffness as well as rotational stiffness, thereby enhancing the ability of the linear induction motor 11, 12 to provide smooth, quiet motion to the car door 13 and the hoistway door 48. Of course, the vanes 33, 34 need not be perfectly parallel to each other nor absolutely vertical; it suffices that the vanes can be wedged between suitable rollers so as to provide horizontal and rotational stiffness between the elevator car door 13 and the hoistway door 48, as described.

The bumpers are preferably rollers 40, 43 disposed for rotation on corresponding axles 44–47 so as to permit relative vertical motion between the elevator car door 13 and the hoistway door 48 during advance door opening and, even after the door is opened, releveling of the elevator, as is known. However, instead of rollers 40–43, suitable self-lubricating bumpers, might be made of delrin or nylon, may be used if desired. The links 22, 23 are shown and described as being near the end of the vanes 33, 34; however, that is deemed herein to include any suitable spacing along the vanes. The vanes are disposed to the links by the pivots on the other legs of the angles.

Figure 6:
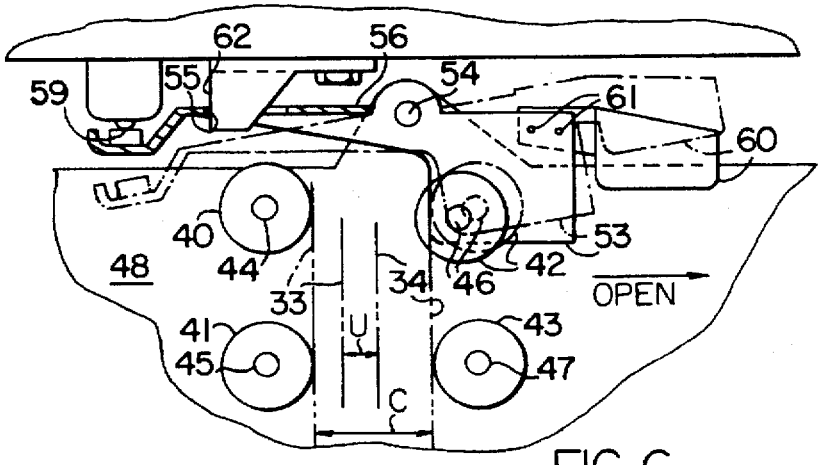
FIG. 6 is a simplified, partial, partially sectioned rear elevation view of the rollers shown in FIG. 2, being a front elevation view of the interlock apparatus disposed on a hoistway door.

Referring now to FIG. 6, the rollers 40–43 are being viewed oppositely to the view of them in FIG. 2. In FIG. 2, the view is toward the elevator car door, whereas in FIG. 6 the view is toward the hoistway door. In FIG. 6, the axle 46 is disposed for rotation on a switch/lock plate 53 of a hoistway interlock which is rotatable about a pivot 54 in response to the vane 34 moving from the uncoupled position of FIGS. 2 and 3 into the coupled position of FIGS. 4 and 5. The pivot 54 is connected to the hoistway door 48. The resulting position of the switch/lock plate 53 is shown in dotted lines in FIG. 6. The switch/lock plate 53 has a lip 55 formed in a shelf 56 thereof, the shelf 56 extending outwardly to a point where it makes electrical contact between the safety switch contacts 59, in a well-known way. The plate 53 has a small weight 60 fastened thereto in any suitable way such as by rivets 61. The weight 60 ensures that the lip 55 will engage a latch 62 whenever the hoistway door 48 is moved to the closed position as shown in FIG. 6.

When the armature 14 is actuated, just prior to door opening, the spring 49 is compressed as seen in FIG. 5 and the released 14 will cause the vanes 33, 34 to spread, thereby moving the roller 42 to the right as seen in FIG. 6, causing the plate 53 to rotate counterclockwise about the pivot 54 against the gravitational force of the weight 60. The action of the roller 42, the plate 53, the lip and latch 55, 62 and safety switch contacts 59 are all as is known in the prior art. However, in the prior art, only two rollers 40, 42 are utilized to couple the elevator car door to the hoistway door.

The foregoing describes the operation of the car doors and hallway doors and the exemplary coupler which is the subject of the commonly owned copending U.S. patent application Ser. No. 08/225,220 entitled Stationary Actuator Moving Vane Elevator Car Door Coupling filed Apr. 8, 1994 which is incorporated herein by reference. Referring back to FIG. 2, the evacuation deterrent device comprises an upwardly extending projection 70 at the upper end of vane 34 and a locking plate 72 extending downwardly from the mounting support of the motor 11. The locking plate 72 is positioned to abut the projection 70 (as shown in broken line in FIG. 2) if the vane 34 overtravels its center pivots 35, 36 past the coupled positioned shown in FIG. 5.

The vanes 33, 34 may be weighted to cause the vane 33 to pivot downwardly and the vane 34 to pivot upwardly when the shelf 20 is displaced off of the cap 16 by movement of the door 13 is the "open" direction. The spring 49 may also be arranged to assist or cause such pivotal movement. The vanes 33, 34 are dimensioned to engage the rollers 40–43 when the car is within the landing zone, but not otherwise.

During flight of the car through the hoistway, the vanes 33, 34 are held in the compressed position as shown in FIG. 2. In the event of an attempted manual opening of the car door by a passenger outside of the landing zone, the initial movement of the door will cause the shelf 20 to move off of the cap 16 and the vanes 33, 34 will pivot toward the expanded position as shown in FIG. 5. If the car is within the landing zone, the vanes 33, 34 will engage the rollers 40–43 in the coupled position as shown in FIG. 5. In the coupled position, the projection 70 is vertically below the locking plate 72 so that the projection 70 will pass under the locking plate 72 during the opening operation of the doors.

However, if the car is outside of the landing, the vanes 33, 34 will not engage the rollers 40–43 but will overtravel the pivot points 35, 36 such that the projection 70 will abut the locking plate 72 to prevent further movement of the doors. Thus, the passengers will be unable to manually open the door past a short distance (i.e., no greater than two inches) to move the shelf 20 off the cap 16 and allow the vanes to pivot from the compressed position to the overtravel locking position. While the evacuation deterrent device has been described relative to the door coupler of FIG. 2, it should be appreciated that other moving vane door couplers and assemblies may also be utilized.

Referring to FIG. 1, a simplified diagram of a moving vane coupler includes an evacuation deterrent device as described above and with a hold-close device for preventing manual opening of the car door during flight.

In the illustrated embodiment generally comprises device generally comprises a friction pad 74 at the upper end of the vane 33, a friction pad 76 on the lower surface 78 of the support for the motor 11 and an actuator 80 mounted to the side of the motor support.

A roller arm 82 is mounted to the upper end of vane 33 and has a roller 84 mounted at its outer end. The actuator 80 has an open-sided channel bracket 86 mounted to the end of plunger 88. When the vane assembly is in the compressed position for movement of the elevator car, the roller 84 is supported on the bottom wall 90 of the bracket 86 and the actuator is energized to urge the vane 33 upwardly such that the friction pad 74 is held against the friction pad 76 of the motor mount 78. The friction pads 74, 76 are in engagement so as to prevent relative transverse movement thereby preventing movement of the elevator doors. Code requirements generally require that the doors be held closed with a minimum locking force of 450 Newtons.

As can be appreciated, the hold-closed device utilizes the upward vertical motion of the vane 33 of the moving vane coupler to hold the doors closed. When the coupling is in the uncoupled position, the actuator 80 through vane 33 provides a force in the up direction to keep the friction pad 74, 76 in contact and prevent the car door from being opened manually. When the car is at a landing and the car doors are to be coupled to the hallway doors, the actuator is deenergize and a spring (not shown) or weight pivots the vane 33 downwardly and the vane 34 upwardly into the coupled position separating the friction pads 74, 76. While the illustrate embodiment utilizes friction pads 74, 76 for retentive engagement between the upper end of vane 33 and the lower surface 78 of the motor 11, other types of retentive engagement configurations may be utilized which provide sufficient holding against transverse force yet allows movement in the normal or downwardly direction.

In the coupled position, the vanes 33, 34 engage the rollers 40, 42 of the interlock and the projection 70 is positioned below the locking plate 72 to allow the coupled doors to open in the manner previously described.

In the event of a loss of power outside of the landing zone, the actuator 80 will be deenergized and the vane 33 will pivot downwardly separating friction pads 74, 76 and the vane 34 will pivot upwardly. Since the car is outside the landing zone, the vanes 33, 34 will pivot through the coupled position and overtravel the pivot points 35, 36 such that projection 70 (as shown in broken line in FIG. 1) will be horizontally aligned with locking plate 72 to abut locking plate 72 and prevent opening of the car doors. As with the embodiment of FIG. 2, the position, action and details of the actuator and retentive engagement surfaces of the hold-close device may be adapted and varied to specific applications.

As can be seen, an evacuation deterrent device has been described which can be integrated with a moving vane door coupler with only a minimum of additional components. The deterrent device minimizes complexity, alignment and adjustment and affords convenient bypass for service personnel. Accordingly, this device achieves at least all of its stated objectives.

As will be apparent to persons skilled in the art, various modifications and adaptations of the structure above-described will become readily apparent without departure from the spirit and scope of the invention, the scope of which is defined in the appended claim.

What is claimed is:

1. An elevator evacuation deterrent device for limiting movement of the doors of an elevator car to prevent engress comprising:

a vane assembly mounted to an elevator car door for movement therewith and having first and second vanes pivotally connected by first and second links to form a parallelogram pivotally movable between a first compressed position, a second intermediate expanded position where said vanes are positioned to engage a pair of bumpers on an adjacent hallway door and a third overtravel locking position when said elevator car is outside a landing zone, a locking plate fixed to the elevator car, and said first vane having first and second ends with said first end being configured to abut said locking plate when said vane assembly is in said third overtravel position to limit movement of said car door and to clear said locking plate when said vane assembly is in said second intermediate position to allow full movement of said car door.

2. The device of claim 1 wherein said first and second vanes are vertically disposed with upper and lower ends and said upper end of said first vane abuts said locking plate to limit movement of the car door.

3. The device of claim 2 wherein said first vane is configured to pivot upwardly as said vane assembly pivotally moves from said second intermediate expanded position to said third position and said upper end of said first vane is vertically below said locking plate when said vane assembly is in said second intermediate expanded position.

4. The device of claim 1 wherein said vane assembly is weighted to bias said vane assembly toward said third position.

5. The device of claim 1 further comprising a spring connected to bias said vane assembly toward said third overtravel position.

6. The device of claim 1 wherein a pair of bumpers are positioned on an adjacent hallway door and comprise first and second rollers of a hallway door interlock and said first and second vanes engage said respective rollers when said vane assembly is in said second intermediate expanded position to couple said elevator car door and said hallway door.

* * * * *